US008312752B2

(12) United States Patent
Patuzzi

(10) Patent No.: US 8,312,752 B2
(45) Date of Patent: Nov. 20, 2012

(54) KINEMATIC SYSTEM FOR CLAMPING SEMIFINISHED PRODUCTS BY MEANS OF PRESSING FOR SHEET METAL SHAPING PANELLING MACHINES

(75) Inventor: Luigi Patuzzi, Monteforte D'Alpone (IT)

(73) Assignee: Finn-Power Oy, Kauhava (FI)

( * ) Notice: Subject to any disclaimer, the term of this patent is extended or adjusted under 35 U.S.C. 154(b) by 698 days.

(21) Appl. No.: 12/439,682

(22) PCT Filed: Sep. 4, 2006

(86) PCT No.: PCT/IT2006/000637

§ 371 (c)(1),
(2), (4) Date: Jul. 14, 2009

(87) PCT Pub. No.: WO2008/029421

PCT Pub. Date: Mar. 13, 2008

(65) Prior Publication Data

US 2009/0308128 A1 Dec. 17, 2009

(51) Int. Cl.

| | |
|---|---|
| ***B21D 11/00*** | (2006.01) |
| ***B21J 9/18*** | (2006.01) |
| ***F16C 3/04*** | (2006.01) |

(52) U.S. Cl. ..... 72/306; 72/319; 72/450; 74/595

(58) Field of Classification Search ..... 72/306, 72/309, 310, 311, 312, 314, 450, 449, 452.5, 72/319, 316, 451; 74/595
See application file for complete search history.

(56) References Cited

U.S. PATENT DOCUMENTS 5,694,801 A * 12/1997 Takahashi et al. ..... 72/319
6,662,619 B1 * 12/2003 Ikeda ..... 72/319

FOREIGN PATENT DOCUMENTS

| | | |
|---|---|---|
| JP | 2003 010919 | 1/2003 |
| WO | WO 98/01244 | 1/1998 |
| WO | WO 2006/043292 | 4/2006 |

* cited by examiner

*Primary Examiner* — Dana Ross
*Assistant Examiner* — Mohammad I Yusuf
(74) *Attorney, Agent, or Firm* — Greenberg Traurig, LLP

(57) ABSTRACT

A kinematic system of movement for the clamping/pressing unit of a semifinished piece, that is to say of sheet metal or the like, of panelling machines, the kinematic system comprising a frame on which a presser unit is hinged to a pin and which is free to make angular movements around the pin, the presser unit consisting of elements v fixed to a head supporting the upper presser tool, the presser unit being moved angularly by at least one connecting rod driven by a first lower crank, in which the presser unit is driven by a second upper crank, the first and second crank defining an articulated mechanism, for driving the punch-presser unit, with two degrees of freedom in sequence that can be activated independently or simultaneously.

8 Claims, 4 Drawing Sheets

KINEMATIC SYSTEM FOR CLAMPING SEMIFINISHED PRODUCTS BY MEANS OF PRESSING FOR SHEET METAL SHAPING PANELLING MACHINES

This application is a national stage filing under 35 U.S.C. 371 of International Application PCT/IT2006/000637, filed on Sep. 4, 2006. The entire teachings of the referenced Application are incorporated herein by reference. International Application PCT/IT2006/000637 was published under PCT Article 21(2) in English.

TECHNICAL FIELD

This invention concerns a kinematic movement system for the clamping/pressing unit of semifinished products, that is to say of sheet metal, of new generation panelling machines, that is to say automatic machines for bending and shaping sheet metal.

This kinematic system, suitable for electrical control and designed specifically for this, consists of a particular kinematic chain of the pressing unit, the unit which clamps the sheet metal during bending and which, unlike currently produced units, overcomes their main limitations.

The system according to the invention can be applied to a panelling machine electrically controlled by means of motors which rotate the sheet metal clamping unit, often called a punch or presser unit.

This system makes it possible to limit the working torque necessary to guarantee clamping of the sheet metal being pressed to within acceptable and limited values, even if additional auxiliary tools are used positioned between the presser element and the fixed counter-blade.

This invention can be applied in the production sector of sheet metal panelling machines and industrial bending machines.

BACKGROUND ART

It is known that the industry involving the production of sheet metal items uses panelling machines that allow a series of bends to be made on the same piece of sheet metal, in a controlled and totally automatic way, so as to obtain a finished product such as, for example, a cooker extractor hood or a shelf.

It is also known that panelling machines or sheet metal bending machines normally consist of:

- a fixed bed for supporting the material, for example sheet metal, to be pressed;
- a support frame for a clamping press;
- a punch or presser, forming part of the press, and a corresponding counter-press or counter-blade, acting as clamping means for the material during bending;
- one or more auxiliary elements, for manual or automatic insertion, commonly called auxiliary tools, forming part of the press, to be positioned between the punch and the corresponding counter-punch or counter-blade, specifically constructed and acting as clamping means for the material during bending of particular pieces;
- one or more bending blades which can be moved towards the material being processed;
- appropriate kinematic systems designed to move the blade or blades along the bed for the shaping of the piece clamped between the punch and the counter-punch;
- appropriate kinematic systems designed to move the punches which allow the clamping and release of the sheet metal, also in the presence of auxiliary tools, guaranteeing a pressing force that always corresponds to the length and thickness to be bent;
- means of movement for the sheet metal, or the section, in order to move it near the blades in working conditions;
- transducers and sensors of various types, to control the process, connected to an electronic control unit governing the production process.

A bending machine of the known type described above, marketed by the applicant, comprises a blade-holder structure with a "C"-shaped cross-section, mobile in two directions at right angles to each other with respect to a fixed bed, on which the bending blade(s) is(are) fixed.

The profile of the bend that can be obtained on a known automatic panelling machine is not just the classic 90° profile that can be obtained with a manual bending machine. The simultaneous control of the positioning of the blade and of the pressure exerted on it make it possible to obtain radial profiles.

The use of traditional blades, particular tools and dies during the bending cycle also makes it possible to obtain special profiles, without it being necessary for the operator to intervene to vary the length or the special tool used.

Traditionally constructed blades are supported by a C-shaped structure mounted on the main frame and the unit comprises two blades: the upper one for shaping negative bends (facing downwards) and the lower one for positive bends (facing upwards).

The system controls the size of the angles and the thickness of the sheet metal, adjusting the position of the blades by means of proportional valves. All the movements are carried out by proportional-control hydraulic cylinders. A special mechanism guarantees the parallelism of the bending unit movements.

The punch or upper presser element is modular in order to obtain the appropriate size of the piece to be machines and contractable to allow extraction of the machined piece. It is mounted on an electrowelded structure with four arms and hinged to the rear part of the main frame.

Thanks to the action of appropriate mechanisms each segment can be released and repositioned very easily, since a trigger prevents the segment falling from the tool-holder bar.

The movements of the C-shaped structure and of the upper tool are controlled by hydraulic cylinders rather than by electric motors.

The position of the cylinders, or electric motors, is controlled by a special system (numerical control or similar) in such a way as to allow the greatest degree of precision during all the bending stages.

Traditional hydraulic panelling machines, like other panelling machines on the market, are equipped with a kinematic system which determines and controls the movement of the blade-holder unit.

This structure can in some cases be the pentalateral type, that is to say consisting of a closed kinematic chain with five members connected by five kinematic pairs.

In hydraulic machines the traditional pentalateral type kinematic chain is used, however, to give the machine torsional rigidity and does not therefore have specific mechanical functions.

In the patent application PCT/IT2004/000581 the same applicant invented a particular kinematic chain with two degrees of freedom, currently the only one that allows electrical control of the bending blade.

The same applicant recently introduced a series of panelling machines on the market which are characterised by electrical control of the bending axes and of the punch/presser, that is to say all the axes that provide torque and absorb significant power exploiting the invention described above.

This new series of machines, well received by the market, presents the following features:

- reduced energy consumption (more than halved compared to a corresponding hydraulic machine);
- less noisy and more respect for the environment;
- better control of the pressing and bending axes with consequent better results in terms of component finish;
- improved performance in terms of speed and cycle time compared with all the machines currently on the market;

The kinematic designs for control of the punch/presser in machines currently produced are shown in FIGS. 1*a* to 3*a*, while FIGS. 1 to 3 show the respective machines, characterised by the use of a mechanical design defined articulated quadrilateral.

As can be seen in the figures this is the kinematic design defined as four bar linkage which works close to a singular configuration in order to ensure an adequate pressing force for kinematic amplification of the delivered torque.

FIGS. 1 to 3 show the components of the punching machines currently produced with a four bar linkage structure. In the three figures, which represent the known art, A indicates the frame, B the driving crank, C the connecting rod, D the presser arm and E an auxiliary tool. FIGS. 1*a*, 2*a* and 3*a* show the respective kinematic designs.

The kinematic designs for the control of the punch/presser in machines; of this type present the following limitation:

- if the machine is used with auxiliary tools positioned between the punch/presser and counter-punch or counter-blade (and in any other similar situation), the kinematic system works in unfavourable conditions, in which the pressing forces delivered are considerably reduced and insufficient (around_of the maximum force necessary) to guarantee the stability of all the sheet metal that can be processed on the machine (see figure of the kinematic system);
- in the form of a graph provided to the users, the maximum limits (length, thickness, type of material) are defined for the use of auxiliary tools positioned between the punch/presser and counter-punch or counter-blade (see graph).
- this kinematic system is currently a limitation to the development (greater lengths and thicknesses) of the range of electric panelling machines, due to the technical impossibility of emitting greater torque; overcoming this limitation would allow the gradual replacement of the hydraulic Express Bender (EB) machine with the more modern and performing EBe in all the sizes produced.

DESCRIPTION OF THE INVENTION

This invention proposes to provide a kinematic system for driving the pressing units of panelling machines that is able to eliminate or reduce the drawbacks described above, summarised in a reduced pressing force available when using auxiliary tools or when the pieces to be machines are particularly long or thick.

The invention proposes first of all to provide a kinematic system for driving the working units of a new design of panelling machine, which foresees the use of servomotors and epicycloidal or spheroidal reduction gears, that is to say motors with a high torque output (torque motors or similar) instead of traditional hydraulic actuators, for the movement of the pressing unit.

The servomotors and reduction gears in fact make it possible to achieve much higher performances than those of a hydraulic system, above all in the clamped rotor functioning typical of pressing operations.

This electrical control is made possible by a kinematic system for driving the pressing units of a panelling machine, the features of which are described in the main claim.

The invention proposes to ensure nominal punch force both for standard use and when used with auxiliary tools positioned between the punch/presser and the counter-punch or counter-blade.

The kinematic system for driving the pressing unit of a panelling machine according to the invention proposes to significantly reduce the torque necessary to clamp the sheet metal compared to the solutions currently used.

The two degrees of freedom kinematic system for driving the pressing unit of a panelling machine according to the invention proposes to allow the easy pressing with limited working torque of thick elements (double thickness or more) by means of the simultaneous use of sequence axes.

The dependent claims of the solution in question describe advantageous embodiments of the invention.

The main advantages of this solution concern first of all the fact that the punch/presser unit of the panelling machine can deliver the maximum pressing force both for standard use and for use with interpositioned auxiliary tools.

Further advantages lie in the fact that the original articulated mechanism presents a sequence of two degrees of freedom that can be activated independently or simultaneously.

This allows extremely rapid opening achieved by activating both axes in sequence, with a further reduction in cycle times and a consequent increase in machine performance.

This makes it possible to use both axes for pressing thick elements, with a consequent distribution of the pressure (torque) on both the sequence axes, that can thus be smaller in size, to the advantage of machine production costs.

DESCRIPTION OF THE DRAWINGS

Other features and advantages of the invention will become evident on reading the following description of one embodiment of the invention, provided as a non-binding example, together with the help of the accompanying drawings in which:

FIGS. 1*a* to 3*a* are schematic views of the relative functional design;

FIGS. 4*a* to 6*a* show the kinematic designs relative to the situations shown in FIGS. 4 to 6;

DESCRIPTION OF ONE EMBODIMENT OF THE INVENTION

Figure 3:
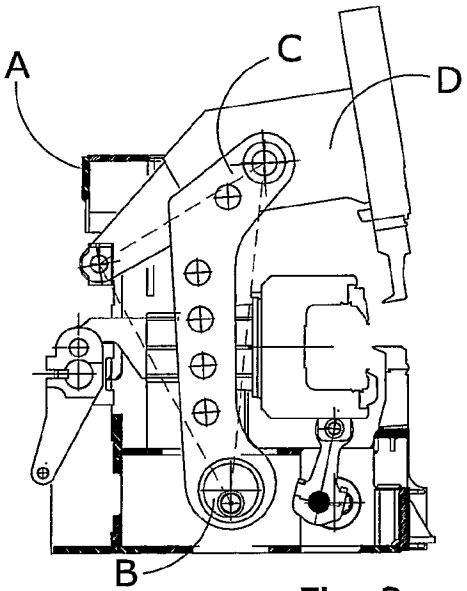
FIGS. 1 to 3 are schematic side views of a traditional type pressing machine.
Figure 3A:
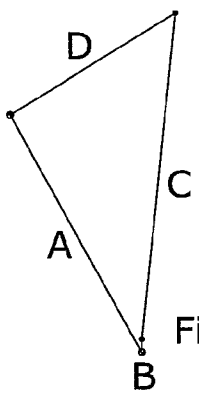
Figure 2:
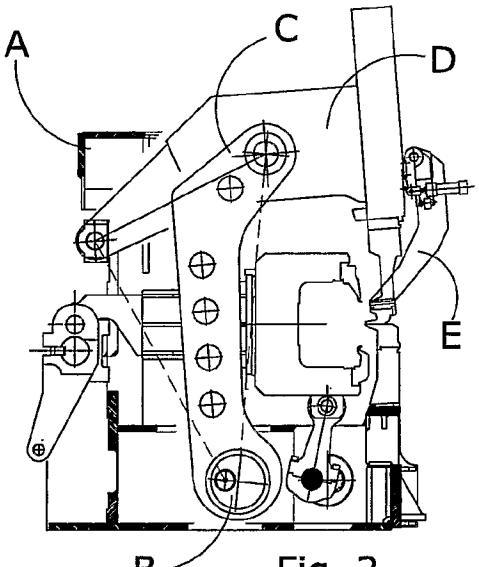
Figure 2A:
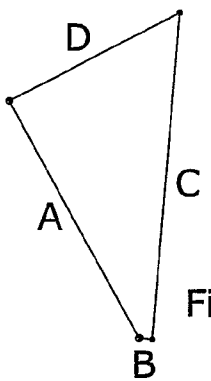
Figure 1:
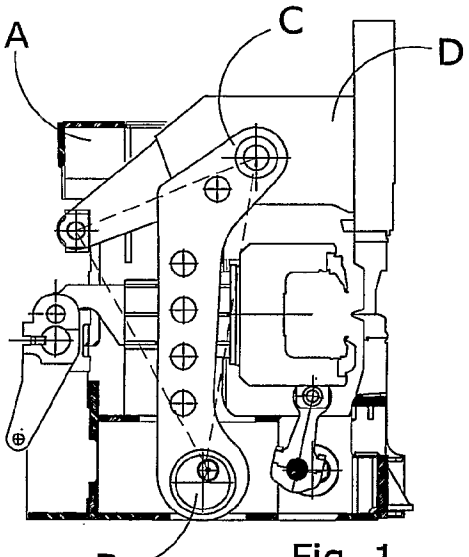
Figure 1A:
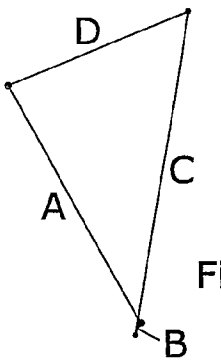
Figure 4:
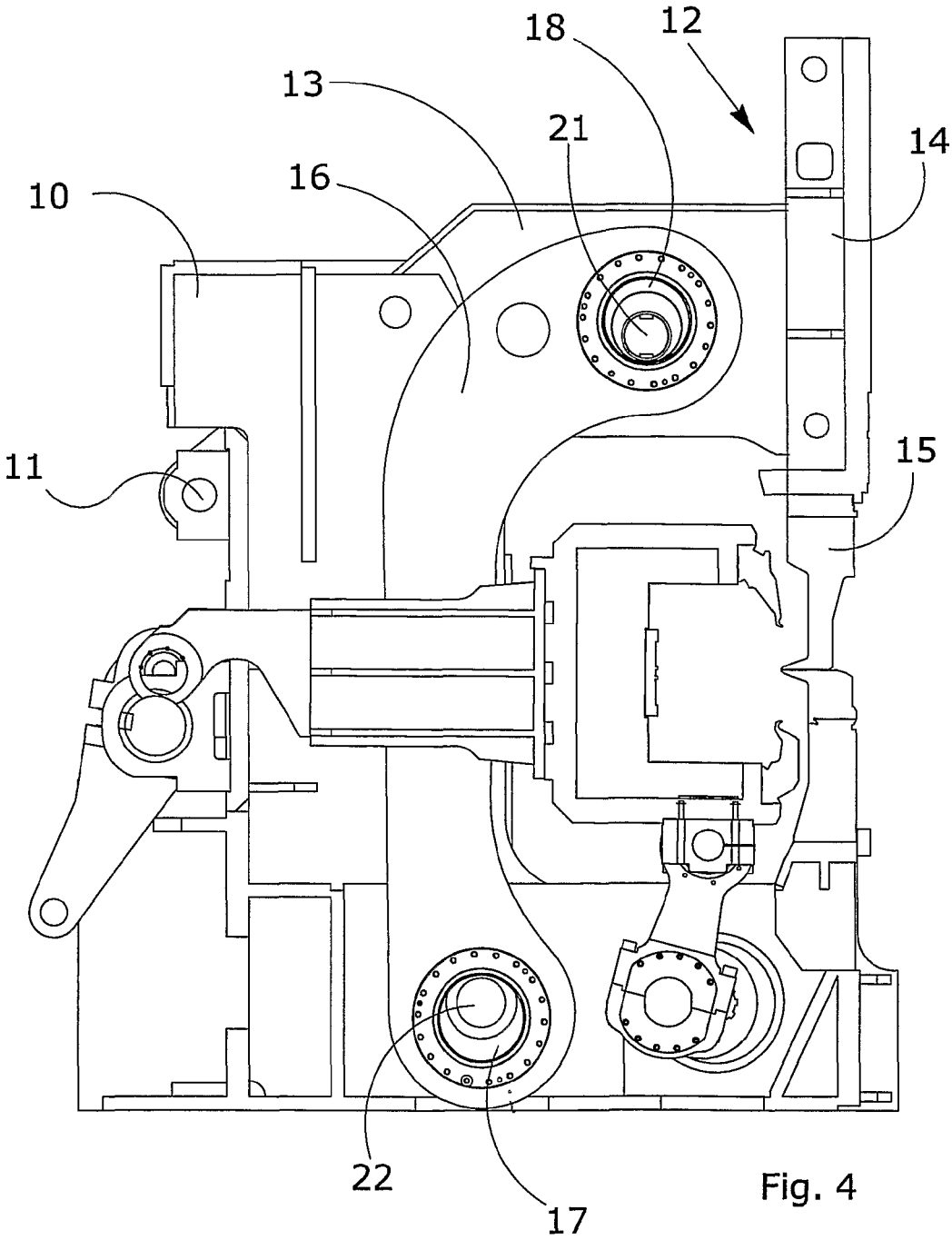
FIG. 4 is a schematic side view of the kinematic system according to the invention which activates the pressing system in the closed position of a panelling machine.
Figure 4A:
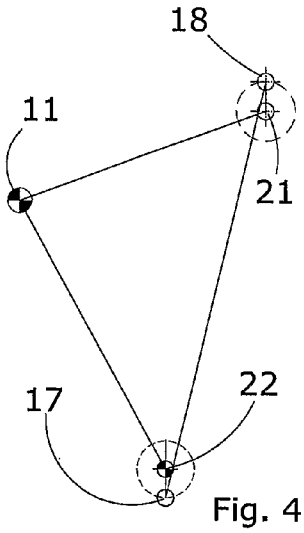
Figure 5A:
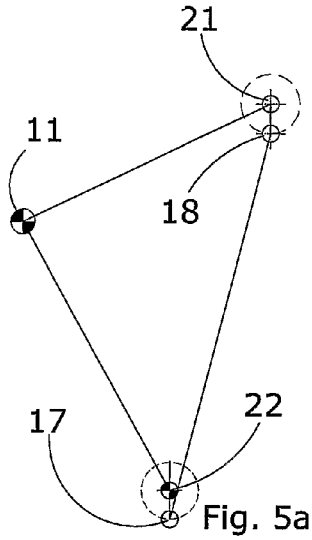
FIG. 5 shows a schematic side view of the same kinematic system in which an auxiliary tool is inserted.
Figure 6A:
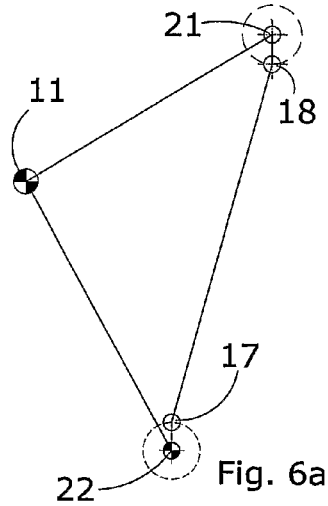

As stated previously, FIGS. 1 to 3 and 1*a* to 3*a* are schematic views showing the construction of currently produced punching machines with a four bar linkage structure, while FIG. 4 shows a machine equipped with the kinematic system according to the invention and which activates the pressing system to a closed position of a panelling machine.

Substantially the machine according to the invention consists of a frame 10 on which a presser unit 12 is hinged to a pin 11 and is free to carry out angular movements around the pin 11.

As shown in FIG. 8, the presser unit 12 consists of a pair of elements 13 which are fixed to a head 14 supporting the upper presser unit 15.

The presser unit 12 is moved angularly by a connecting rod 16, which is activated by a first lower drive crank 17 and a second upper drive crank 18.

From the construction point of view, these first 17 and second 18 cranks are made by using eccentric pins driven by respective independent motors 19 and 20, that is to say servomotors or epicycloidal or spheroidal reduction gears, which act on the shafts 21 of the eccentric pins.

Figure 7:
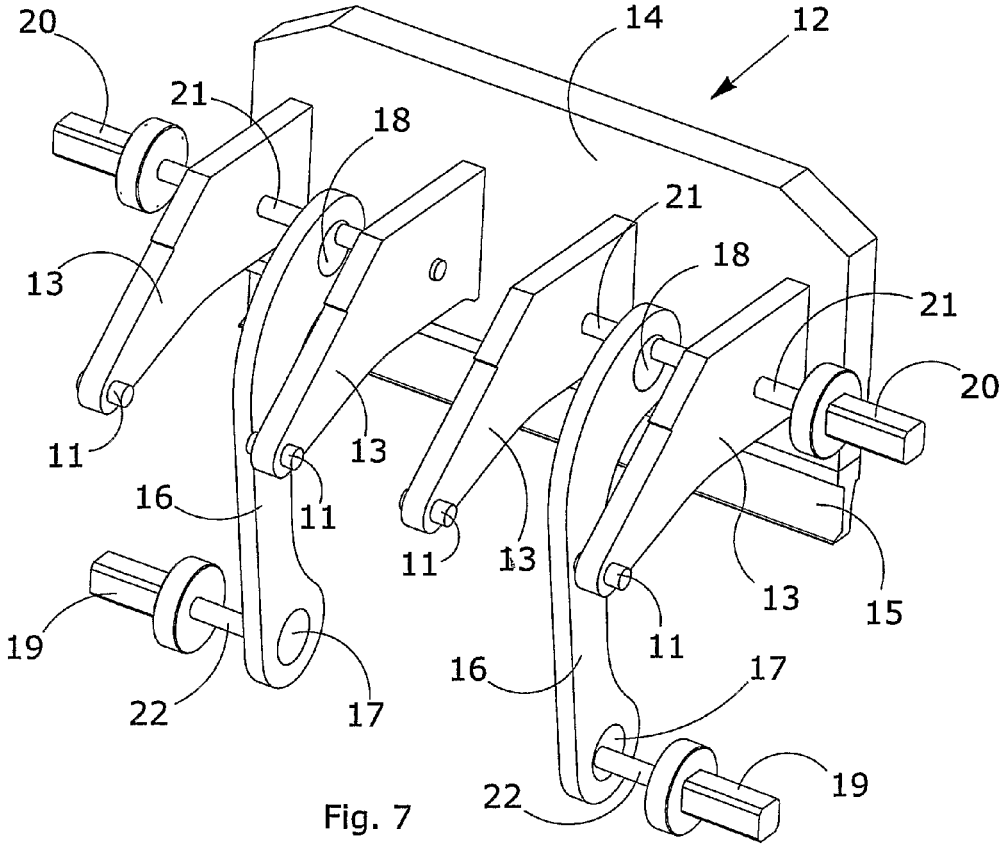
FIG. 7 is a schematic and axonometric view of the overall device according to the invention.
Figure 6:
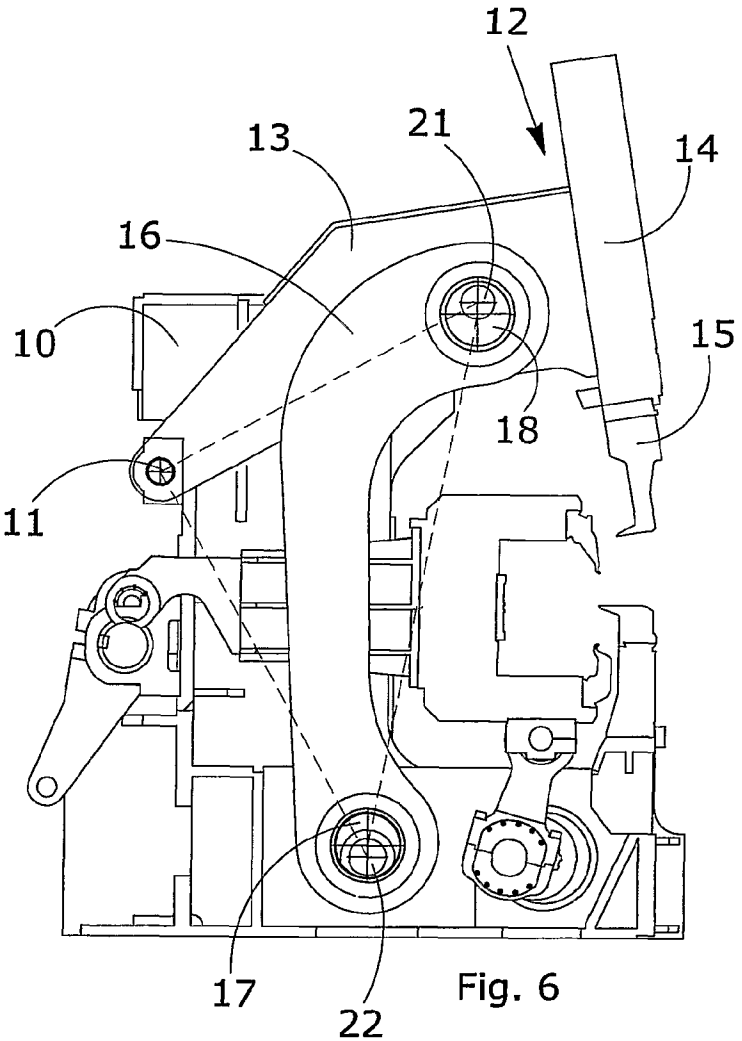
FIG. 6 shows a schematic side view of the kinematic system according to the invention in the open position.
Figure 5:
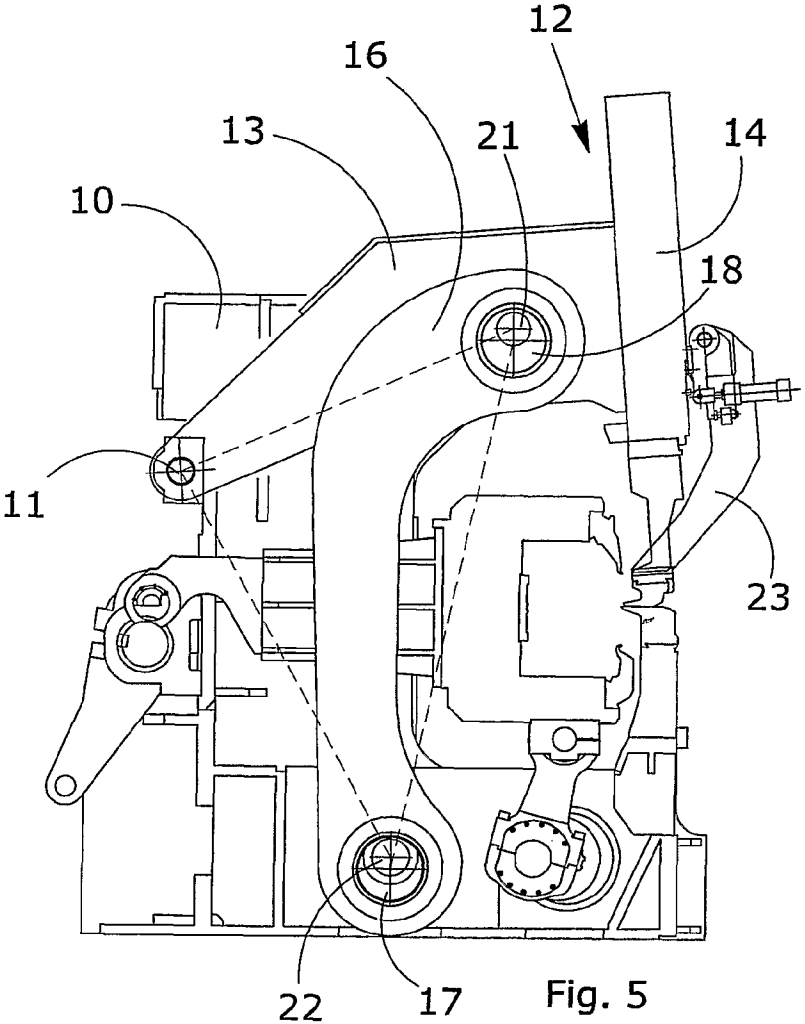

In FIG. 7 the reference number 22 shows the rotation shaft that acts on the eccentric pin 17, while in FIG. 5 the number 23 indicates an auxiliary tool fitted to the head 14.

The described kinematic system for driving the pressing unit of a panelling machine according to the invention proposes to significantly reduce the torque necessary to clamp the sheet metal compared to the solutions currently used.

The two degrees of freedom kinematic system, represented by the first 17 and second 18 cranks for driving the pressing unit of a panelling machine according to the invention, proposes to allow the easy pressing with limited working torque of thick elements (double thickness or more) by means of the simultaneous use of sequence axes.

The punch/presser unit 12 of the panelling machine can deliver the maximum pressing force both for standard use and for use with interpositioned auxiliary tools.

The original articulated mechanism according to the invention, for driving the punch-presser unit, presents two degrees of freedom in sequence that can be activated independently or simultaneously.

This allows extremely rapid opening achieved by activating both axes in sequence, with a further reduction in cycle times and a consequent increase in machine performance.

This also makes it possible to use both axes for pressing thick elements, with a consequent distribution of the pressure (torque) on both the sequence axes, that can thus be smaller in size, to the advantage of machine production costs.

The machine is controlled electrically by means of a mechanism which moves the punch/presser unit and can achieve amplification of the torque sufficient to generate the clamping forces necessary to bend the thicknesses and lengths as per the machine specifications in all working conditions.

The articulated system forming the mechanism is kinematically considered a plane mechanism, where plane mechanism means a mechanism whose members move with plane motion, with the axes of the turning pairs parallel to each other and at right angles to the plane of motion.

From a topological point of view (number of members and type of couplings) this is a closed kinematic chain with five members connected by five kinematic turning pairs.

One of the members is the frame 10 of the machine. This kinematic chain has two degrees of freedom, that is to say it accepts two independent motors, servomotors or epicycloidal or spheroidal reduction gears, in this case represented by two cranks 17 and 18 of the kinematic system driven by the respective motors 19 and 20.

From a geometrical point of view, the mechanism:

- presents particular geometrical configurations (corresponding to kinematic conditions of singularity in the event of kinematic inversion of motion) in a setting of configurations in which the mechanism clamps the sheet metal, with or without auxiliary tools, that generate the necessary amplification of the torque;
- there are four of these configurations, two with features of double singularity and corresponding to the use with and without auxiliary tools placed between the punch and counter-punch.

It should be noted that the mechanism according to the invention is such that it is in the condition of double kinematic singularity (referring to inversed motion) in a setting of both the significant configurations for pressing.

This concept is independent of the geometrical dimensions of the members, including the auxiliary tool, or of the position of the frame kinematic pairs, even if it seems evident that the effect of amplification in some ways depends on these dimensions, like the working space of the machine.

Since the punch or presser of the machine according to the invention is moved by means of a two degrees of freedom articulated system, the motion of the clamping/pressing element, characterised by well-defined movements, is made possible and can be planned by a special and original non-iterative inversed kinematic algorithm which, inserted in the numerical control or used as a pre-processor, makes it possible to carry out simultaneous or independent movements corresponding to well-defined trajectories It should be noted that the singularity consists of:

- the particular kinematic chain with the features described above;
- having applied methods and algorithms typical of the robotics sector to a machine tool, in order to allow motion control by means of different variables to the coordinates of the tool, not at right angles to each other but independent of each other.

This algorithm resolves the position kinematics in a non-iterative way and thus with no error.

The inversed kinematics algorithm consists of the resolution of a closed link, which corresponds to two non-linear closure equations in two unknown quantities.

The non-iterative resolution takes place by means of geometrical type considerations.

According to a particularly advantageous embodiment of the invention, the kinematic elements 13 of the punch-presser unit are arranged in independent pairs, and each pair is driven by respective connecting rods 16 driven in turn by respective independent motors, either servomotors or epicycloidal reduction gears, in such a way as to act independently of each other.

This concept makes it possible to obtain independent thrust torques which, being able to act independently, allow the head of the punch-presser unit to adapt to any irregularities of the piece being machined.

The invention is described above with reference to a preferred embodiment. It is nevertheless clear that the invention is susceptible to numerous variations that lie within its sphere, in the framework of technical equivalents.

The invention claimed is:

1. A kinematic system of movement for a clamping/pressing unit of a semifinished piece of sheet metal or the like, of panelling machines, the kinematic system comprising a frame on which a presser unit is hinged to a pin and is free to make angular movements around the pin, the a presser unit consisting of including two pairs of elements fixed to a head supporting the an upper presser tool, the presser unit being moved angularly by at least one connecting rod a pair of connecting rods driven by a first pair of lower crank cranks, wherein the presser unit is driven by a second pair of upper crank cranks, the first and second crank pairs of cranks defining an articulated mechanism, for driving the presser unit, with two degrees of freedom in sequence activated independently or simultaneously, whereby each crank of said first and second pairs of cranks is provided with said eccentric pin driven by an independent motor including a servomotor and an epicycloidal or spheroidal reduction gear acting on a respective shaft of an eccentric pin.

2. A kinematic system according to claim 1 including from a topological point of view a number of members and type of couplings, the kinematic thrust unit of the punch-presser including a closed kinematic chain with five members connected by five kinematic turning pairs.

3. A kinematic system according to claim 2, wherein one of the members is the frame of the machine, another member is the first crank, the third member is the connecting rod, the forth member is the second crank and the fifth member is a presser unit.

4. A kinematic system according to claim 1, wherein kinematic algorithms define the action without approximation of the tool trajectories.

5. A kinematic system according to claim 4, wherein a non-iterative inversed kinematic algorithms define the action without approximation of the tool trajectories.

6. A kinematic system of movement for the clamping/pressing unit of panelling machines according to claim 1, in which inversed kinematic algorithms allow the definition without approximation of tool trajectories.

7. A kinematic system of movement for the clamping/pressing unit of panelling machines according to claim 1 in which non-iterative inversed kinematic algorithms allow the definition without approximation of tool trajectories.

8. A kinematic system of movement for the clamping/pressing unit of panelling machines according to claim 1, wherein kinematic elements of the punch-presser unit are arranged in independent pairs, and each pair is driven by respective connecting rods driven in turn by respective independent motors, selectively servo motors or epicycloidal reduction gears, to act independently of each other.

* * * * *